US008429883B1

(12) United States Patent
Alkes et al.

(10) Patent No.: US 8,429,883 B1
(45) Date of Patent: Apr. 30, 2013

(54) LIFTING GIRDLE APPARATUS FOR ENHANCING THE PERFORMANCE OF A HARNESS RACING HORSE

(76) Inventors: Allan Alkes, Cold Spring Harbor, NY (US); Eric Koenig, Huntington, NY (US)

( * ) Notice: Subject to any disclaimer, the term of this patent is extended or adjusted under 35 U.S.C. 154(b) by 0 days.

(21) Appl. No.: 13/034,685

(22) Filed: Feb. 24, 2011

Related U.S. Application Data

(60) Provisional application No. 61/307,728, filed on Feb. 24, 2010.

(51) Int. Cl.
*B68B 1/00* (2006.01)

(52) U.S. Cl.
USPC ..... 54/2; 54/50; 54/39.1

(58) Field of Classification Search ..... 54/2, 4, 54/39.1, 50, 69; 278/35, 45, 52, 53, 54
See application file for complete search history.

(56) References Cited

U.S. PATENT DOCUMENTS 532,534 A * 1/1895 Clark ..... 54/2
1,026,751 A * 5/1912 Kershaw ..... 54/50
1,213,907 A * 1/1917 Reinhart ..... 54/50
3,942,305 A * 3/1976 Cameron ..... 54/2
4,414,790 A * 11/1983 Mitchell ..... 54/2
4,543,772 A * 10/1985 Mitchell ..... 54/2
4,986,059 A * 1/1991 Boutilier ..... 54/2
5,775,071 A * 7/1998 Terwilliger ..... 54/71
7,389,749 B1 * 6/2008 Choate ..... 119/726

* cited by examiner

*Primary Examiner* — Rob Swiatek
*Assistant Examiner* — Lisa Tsang
(74) *Attorney, Agent, or Firm* — Edwin D. Schindler

(57) ABSTRACT

A lifting girdle apparatus for enhancing the performance of a harness racing horse includes a lifting girdle affixed to a harness and sulky at two points on each side of the horse with a clip that attaches to the harness, behind approximately the front quarter of the horse, and with a securing strap that runs vertically towards and around the shaft of the sulky. The securing strap is preferably made to be adjustable, for example by constructing the securing strap as a belt and utilizing a belt buckle. The ability to adjust the distance between the attachment clips and the lifting girdle allows for a trainer to configure the lifting girdle device apparatus for different sized horses for producing an optimum setting for horses of almost any size.

6 Claims, 4 Drawing Sheets

LIFTING GIRDLE APPARATUS FOR ENHANCING THE PERFORMANCE OF A HARNESS RACING HORSE

CROSS-REFERENCE TO RELATED APPLICATION

The inventors claim domestic priority, pursuant to 35 U.S.C. §119(e), on the basis of U.S. Provisional Patent Application No. 61/307,728, filed Feb. 24, 2010, the entire disclosure of which shall be deemed to be incorporated by reference herein.

BACKGROUND OF THE INVENTION

1. Technical Field of the Invention

The present invention relates, generally, to a lifting girdle apparatus for enhancing the performance of a harness racing horse.

More particularly, the present invention pertains to a harness for a racing horse having a lifting girdle secured by a securing strap and a girth adjustable via an attachment clip thereby providing a duel lifting upward force that allows for both an improved positioning of the harness, as well as greater securement thereof.

2. Description of the Prior Art

Basic physics states, that when both internal and external forces act upon an object, the object shall move around its center of gravity. This can be seen as the Lift Vector Rotation Point of FIG. 1, which indicates the rotation of the horse's mass around a single point in a conventional single-point harness. This is the spot where the horse's mass will rotate as the horse walks or runs in a normal manner.

In setting up conventional harness racing equipment, the sulky (a lightweight cart having two wheels and a seat for the driver) is attached to the horse at a single point, indicated as the large upward arrow seen in FIG. 1, labeled as the Lift Vector point. In FIG. 1, it can further be seen that the setup of the horse is not in an optimal position because of the premature hoof contact taking place in the lower left of FIG. 1.

FIG. 2 shows a prior art single point harness with the forces placed on the racing animal by the conventional harness assembly presently used. The weight of the driver, indicated as downward vertical force W, acting at the fulcrum distance D, is transmitted over the harness attachment length L, producing the upward lift, indicated at the large upward arrow, as force F.

In FIG. 3, the Lift force acts on the mass of the horse with respect to the center of gravity of the animal. The placement of this Lift force with respect to the center of gravity will determine how the force affects the horse's mass. FIG. 3 further shows the general normalized plane of the horse's backbone at rest. Again, the laws of physics state that any movement of the mass of the horse, above or below the normalized plane of the back, requires the input or exhausting of energy.

FIGS. 4 and 5 show that when the Lift Force (represented by the large upward arrow), produced by the single point harness contact, is placed in front of or behind the center of gravity of the horse, it creates angles of misalignment, seen as $\Phi_1$ of FIG. 4 and $\Phi_2$ of FIG. 5.

The misplacement of the Lift Force, as seen in FIG. 4, produces a "rocking" action of the horse's mass above and below the normalized plane of the backbone. Moving this mass inefficiently consumes the horse's energy in an action other than that required to propel it forward; resulting in loss of speed and available energy needed to sustain the long course of the race. As a result of the misplacement of the Lift Force, as seen in FIG. 4, the running action of the horse causes it to impact the ground with a rear hoof first, before the front hoof has a chance to catch up. This misalignment is represented as $\Phi_1$.

The misplacement of the Lift Force, as best seen in FIG. 5, also produces a "rocking" action of the horse's mass above and below the normalized plane of the backbone. Again, the movement of this mass consumes the horse's energy in an action other than that required to propel it forward; resulting in the same loss of speed and available energy needed to sustain the long course of the race. Here again, but slightly different as that in FIG. 4, the result of the misplacement of the Lift Force, as seen in FIG. 5, the running action of the horse causes it to impact the ground with a front hoof first, before the rear hoof has a chance to catch up. This misalignment is represented as $\Phi_2$.

The only way to increase the efficiency of the racing horse is to reduce the $\Phi_1$ and $\Phi_2$ misalignments to as close to zero as possible—which is practically impossible with the conventional systems in use today.

The only way to increase the efficiency of the racing horse is to reduce the $\Phi_1$ and $\Phi_2$ misalignments to as close to zero as possible—which is practically impossible with the prior art systems in use today.

SUMMARY OF THE INVENTION

It is, therefore, an object of the present invention to provide a lifting girdle apparatus for enhancing the performance of a harness racing house, which provides the capability of setting-up any trotting or pacing racing horse to a harness and sulky, culminating in an optimum capacity for speed and endurance by eliminating wasted energy, and improving range of motion.

The lifting girdle apparatus for enhancing the performance of a harness racing horse includes a lifting girdle affixed to a harness and sulky at two points on each side of the horse with a clip that attaches to the harness, behind approximately the front quarter of the horse, and with a securing strap that runs vertically towards and around the shaft of the sulky. The securing strap is preferably made to be adjustable, for example by constructing the securing strap as a belt and utilizing a belt buckle. The ability to adjust the distance between the attachment clips and the lifting girdle allows for a trainer to configure the lifting girdle device apparatus for different sized horses for producing an optimum setting for horses of almost any size.

The lifting girdle apparatus of the present invention further preferably includes a front neck support extending from the girth and a sulky shaft substantially located between the girth and the securing strap.

Proper use of the invention results in the ability to set-up any trotting or pacing racing horse to a harness and sulky, culminating in an optimum capacity for speed and endurance by eliminating wasted energy, and improving range of motion.

Unlike the conventional harness system, the invention herein offers the trainer an adjustable mechanism to hone the performance of any racing animal to an optimal level that will produce greater racing endurance and overall track speed.

The present invention allows a trainer to match a horse with a harness, sulky, and a driver; allowing for the highest efficiency of usage of the horse's energy during a race.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals and symbols denote similar features throughout the several views.

Figure 4:
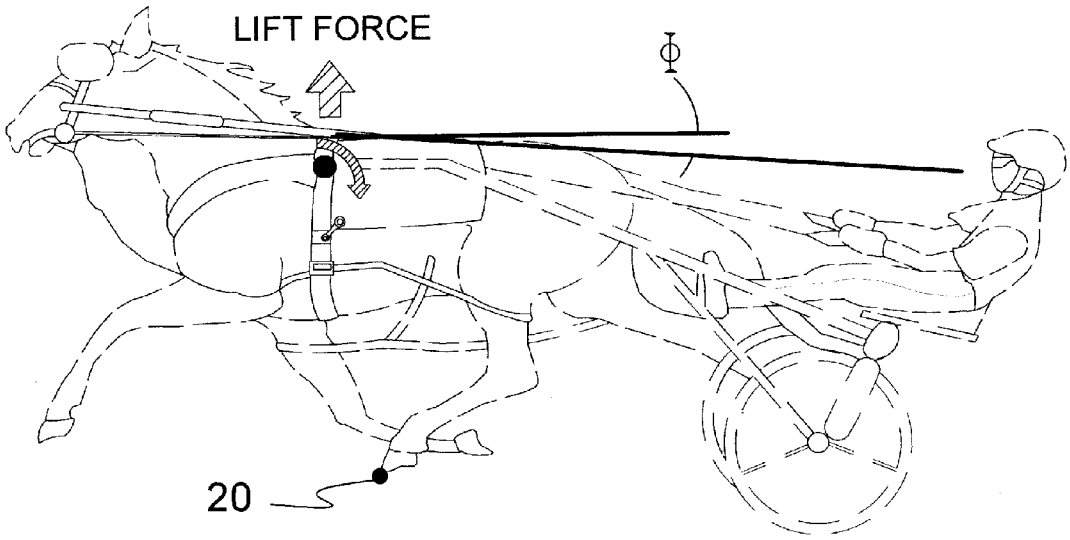
FIGURE-4 PRIOR ART
Figure 5:
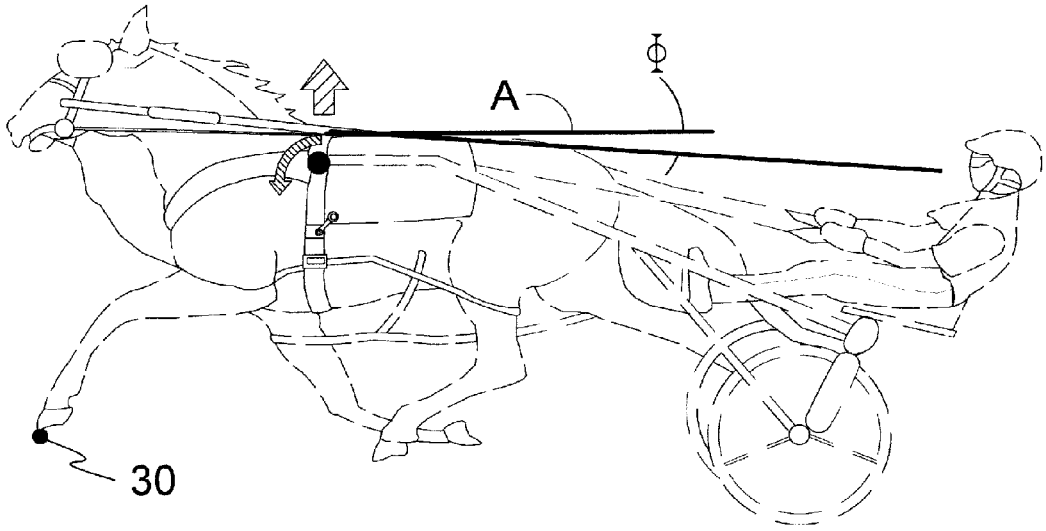
FIGURE-5 PRIOR ART
Figure 6:
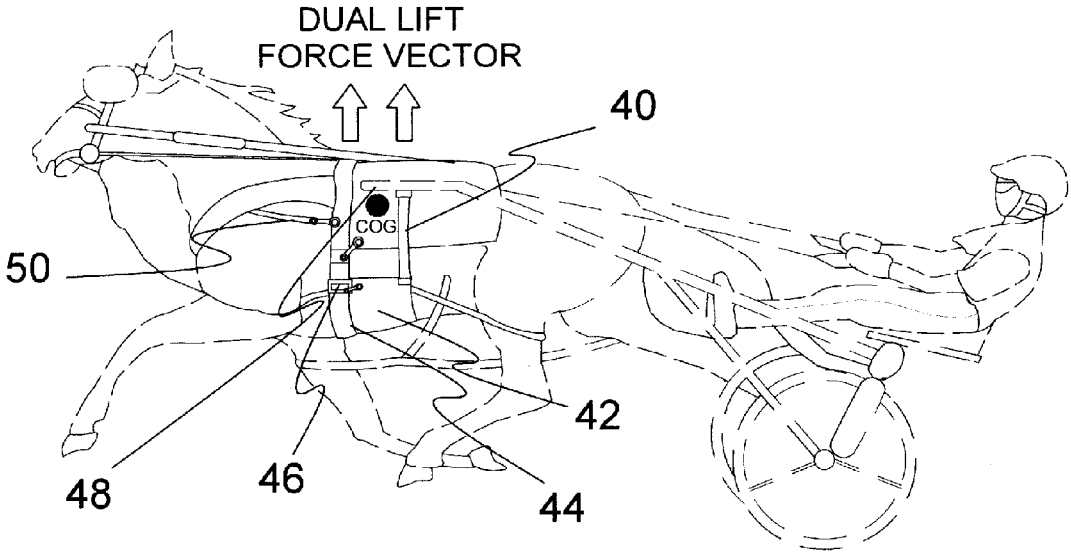

FIG. 4 shows the effect of improper harness placement using the methodology of a prior art single-point harness connection, wherein the angle of misalignment of the horse's back while in-gate is the primary indicator that the sulky lift force is placed improperly forward of the center of gravity of the animal, producing the rotational motion indicated by a semicircular arrow pointer; and can be seen as the horse's rear hooves contact the ground before the front;

FIG. 5 shows a similar type of effect of improper harness placement using the prior art single-point harness connection methodology, wherein the angle of misalignment of the horse's back while in-gate is the primary indicator that the sulky lift force is placed improperly behind the center of gravity of the animal, producing the rotational motion indicated in red; and can be seen as the horse's front hooves contact the ground before the rear;

FIG. 6 shows the lifting girdle apparatus of the present invention, which distributes an even-force in two areas on the animal, producing a centered dual lift force vector more accurately around the center of gravity of the animal, wherein the lifting girdle is affixed to the harness and sulky at two points on each side of the horse with a clip that attaches to the harness, behind the front quarter of the horse; and with a securing strap that runs vertically towards and around the shaft of the sulky.

Figure 7:
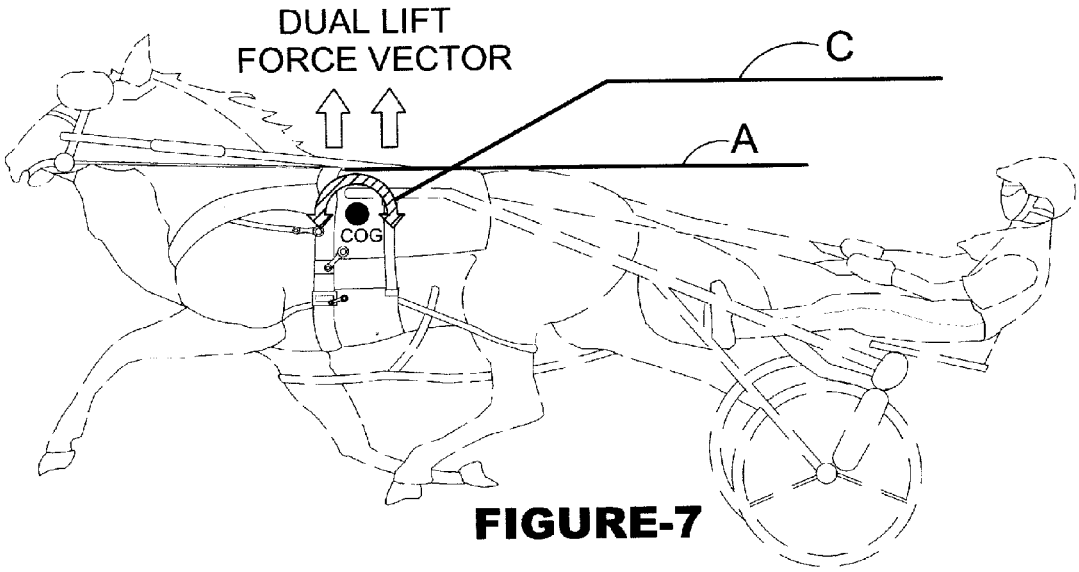
Figure 8:
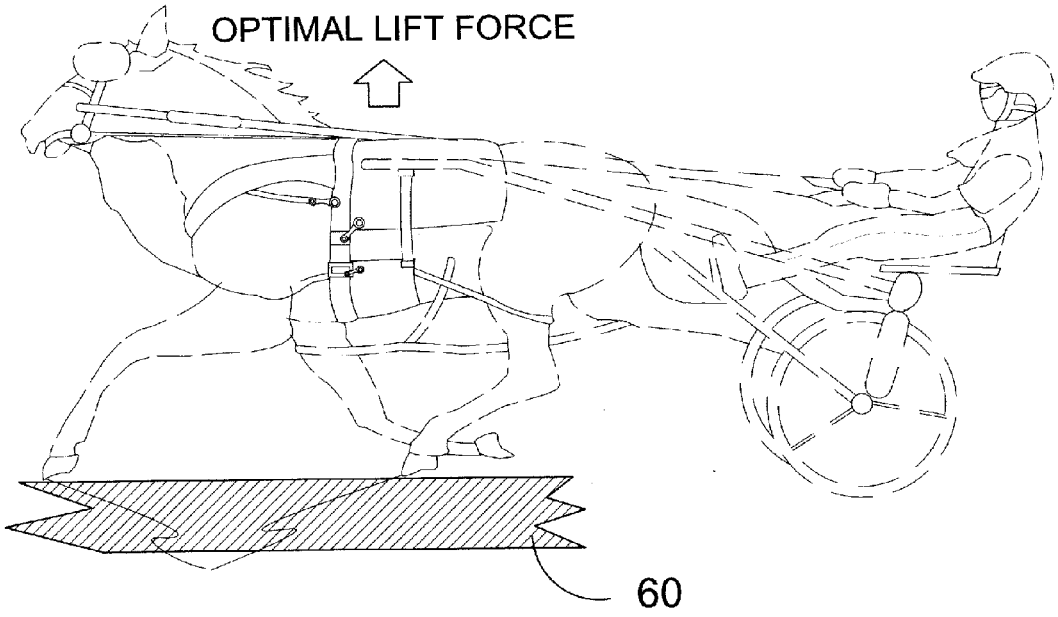

FIG. 7 shows substantially the center of gravity, denoted as a centralized dot and wraparound arrows, with respect to the normalized horizontal plane of the horse's back, and the much-lowered rocking action; and, FIG. 8 shows an improved hoof-to-surface contact when the provided-for invention has been properly fitted to the horse, which also results in an optimal lift force and maximum forward velocity, as also depicted.

DETAILED DESCRIPTION OF THE PREFERRED EMBODIMENTS AND DRAWING FIGURES

FIGS. 1-5 illustrate a conventional single point harness, as taught by the prior art and which have been described in the foregoing description of the pertinent prior art devices. Specifically, the prior art device includes a lift vector rotation point 10. Reference numeral 14 denotes an area of rotation of horse using the prior art device around a single axis. Reference number 12 indicates a point of premature hoof resulting from use of the single point harness of the prior art.

Figure 1:
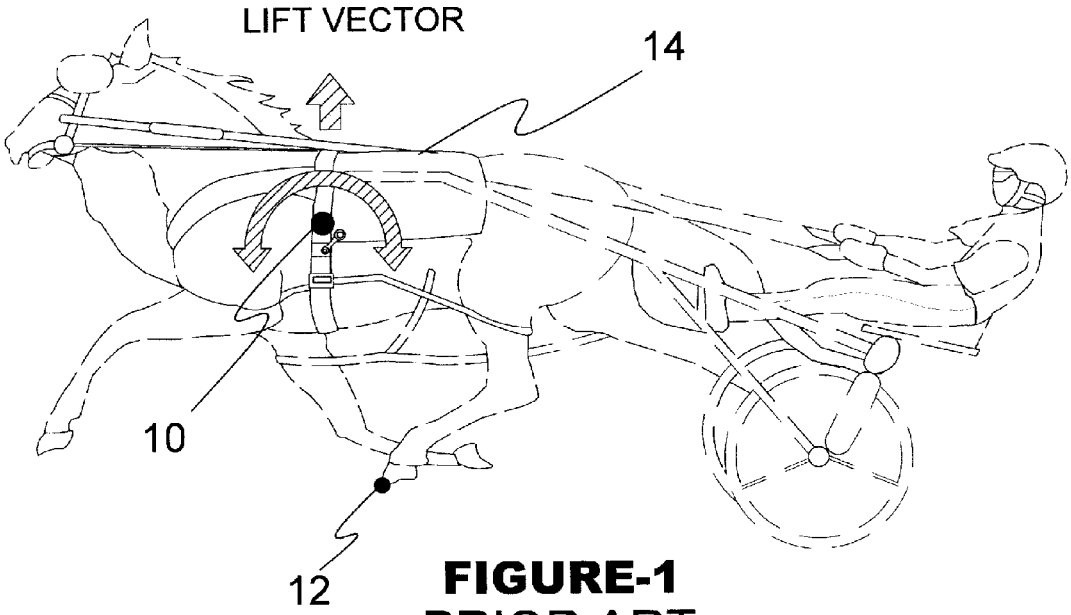
FIGURE-1 PRIOR ART
FIG. 1 shows a prior art sulky-to-harness interconnection point producing the typical lift vector that may be attempting to lift the horse at a spot that is not near the center of gravity of the animal, causing a rocking action around the indicated axis of rotation.
Figure 2:
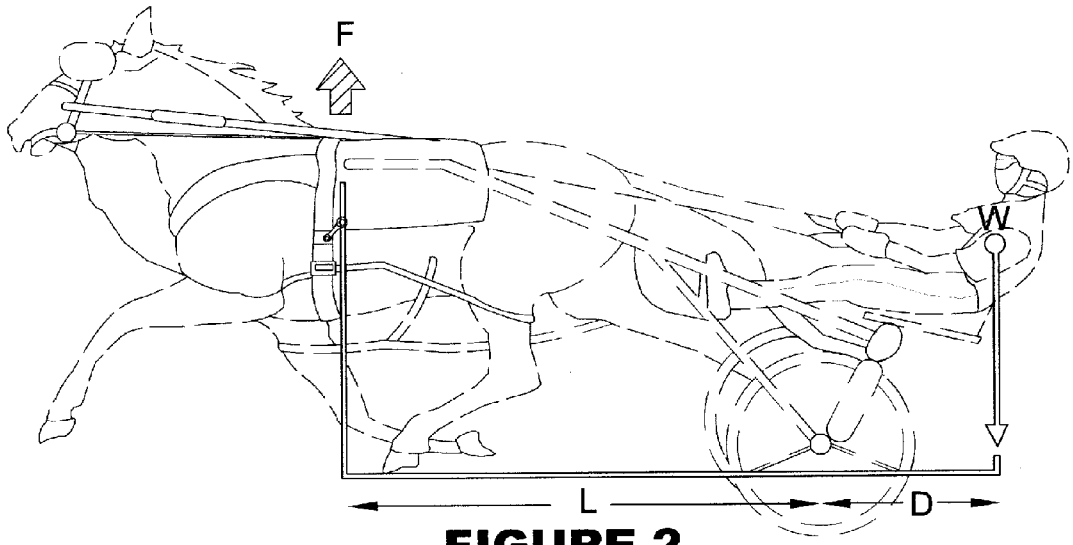
FIGURE-2 PRIOR ART
FIG. 2 shows the lift vector forces imparted to the animal through the prior art sulky-to-harness connection, wherein the lift forces (F) can be seen as those created by the weight of the driver (W), acting at a distance of (D), around the rotation point (X), and imparted to the horse at the level length (L)
Figure 3:
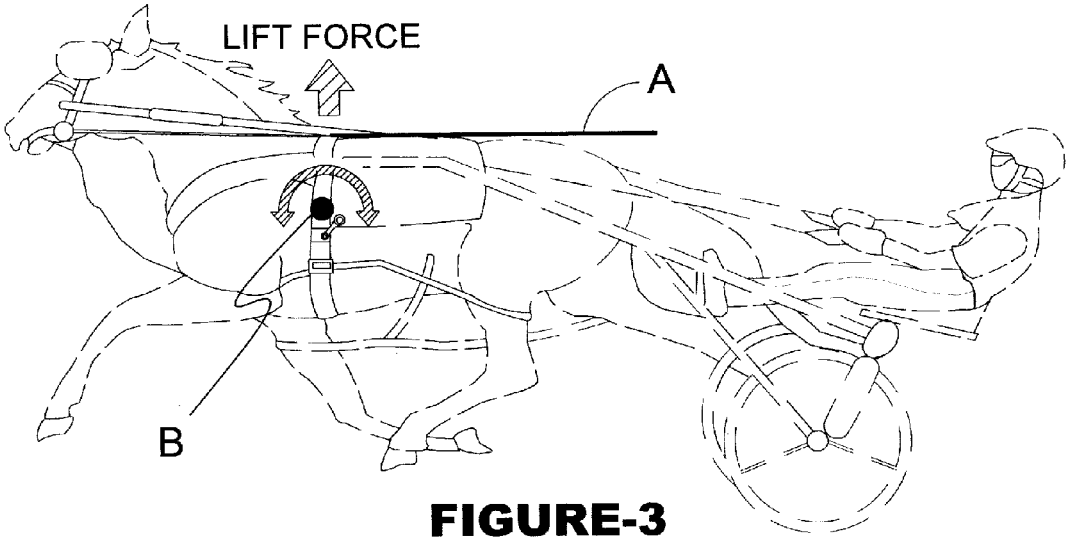
FIGURE-3 PRIOR ART
FIG. 3 shows a prior art single-point harness used in trotter/pacer racing and the single lift harness used to impart the lift forces generated by the sulky to the horse with respect to the normalized horizontal plane of the horse's backbone.

In FIGS. 3 and 5, point A designates a line showing the normal plane of the horse's back illustrated therein. Point B, as designated in FIG. 3, indicates a single point of rotation, though not at the center of gravity. In FIGS. 4 and 5, the Greek letter Φ indicates an angle of misalignment resulting from use of a conventional single point harness. In FIG. 4, reference numeral 20 is intended to indicate that the life force resulting from use of a conventional single point harness results in an incorrect place causing a rear foot of the horse to land first, or before, a front foot. In FIG. 5, reference numeral 30 indicates that the lift force resulting from a conventional single point harness results is incorrect resulting in the front feet of the horse to land first, when not otherwise optimal to do so.

FIG. 6 shows the lifting girdle apparatus of the present invention, which distributes an even-force in two areas on the animal, producing a centered dual lift force vector more accurately around the center of gravity of the animal. A securing strap 40, a lifting girdle 42, girth 44, an attachment clip 46, a sulky shaft 48 and a front neck support 50 are shown in FIG. 6. The present invention uses the principle of a dual lift force vector, as can be seen as the two upward arrows above the horse in FIG. 6. The dual lift forces are imparted to the horse using the girdle 42 fixed to the back of the girth 44 and strapped 40 on each side to the shafts 48 of the sulky in a vertical upward force.

The girdle 42 is held at a distance from the front harness by clips or other means of attachment 46 to the girth 44. The ability to adjust the distance between the clips and the girdle 42 allows for a trainer to configure the device for different size horses, producing an optimum setting for any particular horse.

Using the adjustable front neck support, a trainer can place the dual lift force vector at the precise center of gravity of the horse, allowing for the upward lifting force to act at the optimal point of the mass of the horse, thereby increasing the horse's speed. This point is indicated as COG ("center of gravity") in FIG. 6.

With the ability to now center the upward lift force vector around the center of gravity of the horse (COG), as presented in FIG. 7, even-force can be distributed around the COG with respect to the normal plane of the horse's backbone (A), which greatly reduces the wasted energy expended by the horse in lifting its mass above the normal plane. Line C designates that the dual force vector creates a rotation point that is closer to the center of gravity of the horse, thereby greatly reducing the rotational force.

The optimal achievement for a harness racing horse is for the normal back plane of the animal to remain steady at 0° of misalignment while in stride. This implies that the animal is running flat and even, expending as little energy as is possible rocking forward and backward against gravity. Any lifting of a weight against gravity implies the expending of energy—such expenditure is 100% wasted, as none of it successfully propels the horse forward in motion, and yet still drains the horse's reserve.

The present invention allows for the $\Phi_{TOTAL}$ misalignment to be brought to a minimum level through associated adjustments made by the trainer, creating a situation where the horse will be expending as little energy as possible lifting its weight against the force of gravity with each stride, thereby providing greater endurance over the long haul of the race, and potentially less strides to accomplishing the same distance.

The ultimate goal in racing is to have the animal's front and rear hoof land at the same time, meaning that the horse's back plane need not shift from the normal plane. If the front or the rear hoof comes down first, followed by the other, it means that the horse's body had left the zero normal plane axis, referred to as the "angle of misalignment."

Finally, when the trainer has reached an equipment adjustment that is as close to ideal as possible, the horse's speed will be at a maximum, and the performance will be enhanced to its highest state possible, where the hooves of the animal will be simultaneously striking the ground 60 on each stride, as can be seen in the FIG. 8.

The present invention, by allowing a racing horse to maximize every stride, can allow a horse to add inches per stride by wasting as little of the animal's energy on anything other than propelling it forward.

Just one additional ½ inch in forward propulsion per stride, over a race of 1000 strides, can result in the horse and sulky being more than 10 yards ahead of where it would have been without the invention, and its ability to maximize the horse's performance—and that distance can be the difference between winning and losing a race.

While only several embodiments of the present invention have been shown and described, it will be obvious to those skilled in the art that many modifications may be made to the present invention without departing from the spirit and scope thereof.

What is claimed is:

1. A lifting girdle apparatus for enhancing performance of a harness racing horse, comprising a lifting girdle affixable to a harness and sulky at two spaced-apart locations on one shaft of a plurality of shafts of said sulky on each side of a horse with a clip being attachable to the harness behind approximately a front quarter portion of the horse and with a securing strap running vertically towards and around a shaft of the sulky, said securing strap being rearwardly and laterally spaced from the harness and extending substantially upwardly from and coincident a rear edge of said lifting girdle.

2. The lifting girdle apparatus for enhancing performance of a harness racing horse according to claim 1, wherein said securing strap includes means for adjusting a length of said securing strap.

3. The lifting girdle apparatus for enhancing performance of a harness racing horse according to claim 2, wherein said means for adjusting the length of said securing strap includes a belt buckle.

4. A lifting girdle apparatus in combination with a horse harness for enhancing performance of a harness racing horse, comprising:

a horse harness and a sulky, said sulky having a plurality of shafts for connecting said sulky to said horse harness; and, a lifting girdle apparatus, including:

a lifting girdle affixable to said horse harness and said sulky at two spaced-apart locations on one shaft of said plurality of shafts of said sulky on each side of a horse with a clip being attachable to said harness behind approximately a front quarter portion of the horse and with a securing strap running vertically towards and around a shaft of the sulky, said securing strap being rearwardly and laterally spaced from the harness and extending substantially parallel from and directly secured to a rear edge of said lifting girdle.

5. The lifting girdle apparatus in combination with a horse harness for enhancing performance of a harness racing horse of claim 4, wherein said securing strap includes means for adjusting a length of said securing strap of said lifting girdle apparatus.

6. The lifting girdle apparatus in combination with a horse harness for enhancing performance of a harness racing horse of claim 5, wherein said means for adjusting the length of said securing strap of said lifting girdle apparatus includes a belt buckle.

* * * * *